US008113632B2

(12) United States Patent
Kobayashi et al.

(10) Patent No.: US 8,113,632 B2
(45) Date of Patent: Feb. 14, 2012

(54) LIQUID EJECTING HEAD, LIQUID EJECTING HEAD UNIT, AND LIQUID EJECTING APPARATUS

(75) Inventors: Haruki Kobayashi, Shiojiri (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/071,426

(22) Filed: Mar. 24, 2011

(65) Prior Publication Data

US 2011/0234701 A1 Sep. 29, 2011

(30) Foreign Application Priority Data

Mar. 26, 2010 (JP) ..... 2010-073838

(51) Int. Cl.
*B41J 2/045* (2006.01)

(52) U.S. Cl. ..... 347/68; 347/70

(58) Field of Classification Search ..... 347/68, 347/70–71

See application file for complete search history.

(56) References Cited

U.S. PATENT DOCUMENTS

| | | | | |
|---|---|---|---|---|
| 6,547,373 | B2 * | 4/2003 | Kitahara | 347/68 |
| 6,626,524 | B2 * | 9/2003 | Okazawa et al. | 347/68 |
| 2002/0044179 | A1 | 4/2002 | Okazawa et al. | |

FOREIGN PATENT DOCUMENTS

| | | | |
|---|---|---|---|
| JP | 2001-071486 | A | 3/2001 |
| JP | 2001-113697 | A | 4/2001 |
| JP | 2001-293862 | * | 10/2001 |
| JP | 2001-293862 | A | 10/2001 |
| JP | 2004-203060 | A | 7/2004 |

* cited by examiner

*Primary Examiner* — Juanita D Jackson

(74) *Attorney, Agent, or Firm* — Kilpatrick Townsend & Stockton LLP

(57) ABSTRACT

Concave portions are provided at both side faces of the reinforcing plate in the juxtaposition direction of the actuators on a discharge face side in which the nozzle orifices are opened. Second exposed portions, in which corner portions that include the discharge face sides of convex portions formed by the concave portions and the side faces of the reinforcing plate are exposed, are provided at both side faces of the case in the juxtaposition direction of the actuators.

7 Claims, 10 Drawing Sheets

LIQUID EJECTING HEAD, LIQUID EJECTING HEAD UNIT, AND LIQUID EJECTING APPARATUS

The entire disclosure of Japanese Patent Application No: 2010-073838, filed Mar. 26, 2010 are expressly incorporated by reference herein.

BACKGROUND

1. Technical Field

The present invention relates to a liquid ejecting head which ejects liquid from nozzle orifices, a liquid ejecting head unit, and a liquid ejecting apparatus and, in particular, to an ink jet type recording head which discharges ink as liquid, an ink jet type recording head unit, and an ink jet type recording apparatus.

2. Related Art

As a representative example of a liquid ejecting head, for example, an ink jet type recording head is known which discharges ink droplets from nozzle orifices by using pressure occurring by displacement of piezoelectric elements. In the ink jet type recording head, a portion of a pressure generation chamber communicating with the nozzle orifice is constituted by a vibration plate and an ink droplet is discharged from the nozzle orifice by providing pressure to ink supplied to the pressure generation chamber, by deformation of the vibration plate by the piezoelectric element.

Also, with respect to such an ink jet type recording head, there is proposed an ink jet type recording head in which a piezoelectric element is fixed at one end portion thereof to a vibration plate and at the other end portion to a fixed plate, the fixed plate is fixed to a case, thereby holding the piezoelectric element, and an ink droplet is discharged by generating a pressure change in a pressure generation chamber by deforming the vibration plate by extension and contraction in the axial direction of the piezoelectric element.

In such an ink jet type recording head, since the case is formed by molding of a resin material, there is a problem such that rigidity is low, so that a repulsive force when driving the piezoelectric elements cannot be suppressed. In particular, in a case where the piezoelectric elements are fixed to a housing portion penetrating the case, since at both end portions in a juxtaposition direction of the piezoelectric elements of the case, rigidity is high due to wall surfaces of the housing portion and at the central portion in the juxtaposition direction thereof, rigidity is low, the repulsive force due to driving of the piezoelectric elements cannot be uniformly suppressed, so that the recording head cannot be driven with uniform ink discharge characteristics.

For this reason, there is proposed an ink jet type recording head in which a reinforcing plate made of metal is buried in a case made of a resin material over a juxtaposition direction of piezoelectric elements, whereby the case is reinforced by the reinforcing plate (refer to JP-A-2001-293862 and JP-A-2001-71486, for example).

In this manner, in a case where the reinforcing plate is buried in the case, the reinforcing plate must be positioned at a predetermined position of a mold which molds the case. For this reason, since the case is molded while a portion of the reinforcing plate is held for positioning, the reinforcing plate is provided in a state where the portion of the reinforcing plate is exposed from the case. Such exposed portions of the reinforcing plate exposed from the case are provided at four sides of the periphery of a plate-like member having a rectangular shape. However, since it is not preferable that the exposed portions be present at the adhesion surface side of the case to the flow path unit, the exposed portions are provided at two corner portions on the discharge face side of the side faces and one side on the opposite side to the discharge face.

However, since the two corner portions on the discharge face side are close to the discharge face, some ink discharged from the nozzle orifice adheres to the discharge face and the ink adhered to the discharge face creeps up to the corner portions. The ink which has crept to the corner portions in this manner reaches the exposed portion on the opposite side to the discharge face through an interface between the molded resin of the case and the reinforcing plate and then penetrates from the exposed portion on the opposite side to the discharge face into the housing portion in the case, in which the actuator unit is housed, consequently there is a problem in that the actuator unit is damaged by the penetrated ink.

In addition, such a problem is also similarly present in a liquid ejecting head, which ejects liquid other than ink, as well as the ink jet type recording head.

SUMMARY

An advantage of some aspects of the invention is that it provides a liquid ejecting head, in which penetration of liquid is suppressed, thereby allowing damage of an actuator to be suppressed, a liquid ejecting head unit, and a liquid ejecting apparatus.

According to a first aspect of the invention, there is provided a liquid ejecting head including: a flow path unit in which nozzle orifices and flow paths communicating with the nozzle orifices are provided; a case fixed to the flow path unit; and an actuator unit which is fixed to the case and in which actuators that generate a pressure change in the flow paths are juxtaposed, wherein the case is formed by a resin molding material and also a reinforcing plate is buried in the case over a juxtaposition direction of the actuators, first exposed portions in which the reinforcing plate is exposed are provided at a face on the opposite side to a face of the case, which is fixed to the flow path unit, concave portions are provided at both side faces of the reinforcing plate in the juxtaposition direction of the actuators on a discharge face side in which the nozzle orifices are opened, and second exposed portions, in which corner portions that include the discharge face sides of convex portions formed by the concave portions and the side faces of the reinforcing plate are exposed, are provided at both side faces of the case in the juxtaposition direction of the actuators.

In such an aspect, since the concave portions are provided at the reinforcing plate, whereby the corner portions which are exposed by the second exposed portions are disposed at the opposite side to the discharge face, arrival of liquid or the like adhered to the discharge face at the reinforcing plate exposed by the second exposed portions can be suppressed. Accordingly, adhesion of liquid which has crept an interface between the reinforcing plate exposed by the second exposed portions and the case, to the actuator unit held by the case from the first exposed portions is suppressed, so that damage of the actuators by liquid can be suppressed.

Here, cutout portions which are opened to a face on the opposite side to the discharge face may be provided at both side faces of the reinforcing plate in the juxtaposition direction of the actuators on the opposite side to the concave portions, and the convex portion may be provided between the concave portion and the cutout portion.

Also, it is preferable that at a discharge face side of the flow path unit a cover head which covers the discharge face be provided and the corner portions be covered by the cover head. Accordingly, the discharge face side can be protected by the cover head. Also, even if liquid penetrates between the cover head, the flow path unit, and the case, since the reinforcing plate exposed by the second exposed portions is located away from the discharge face, contact of the penetrated liquid with the reinforcing plate can be suppressed.

Also, it is preferable that the cover head be provided such that a clearance between the cover head and the case gradually increases from the discharge face toward the case side. Accordingly, creeping of liquid penetrated between the case and the cover head to the opposite side to the flow path unit is suppressed, so that contact of the penetrated liquid with the reinforcing plate can be suppressed.

Also, according to a second aspect of the invention, there is provided a liquid ejecting head unit including a plurality of the liquid ejecting heads according to the first aspect.

In such an aspect, a liquid ejecting head unit can be realized in which damage of the actuators is suppressed, whereby reliability is improved.

Also, according to a third aspect of the invention, there is provided a liquid ejecting apparatus including the liquid ejecting head according to the first aspect or the liquid ejecting head unit according to the second aspect.

In such an aspect, a liquid ejecting apparatus can be realized in which damage of the actuators is suppressed, whereby reliability is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

Embodiment 1

Figure 1:
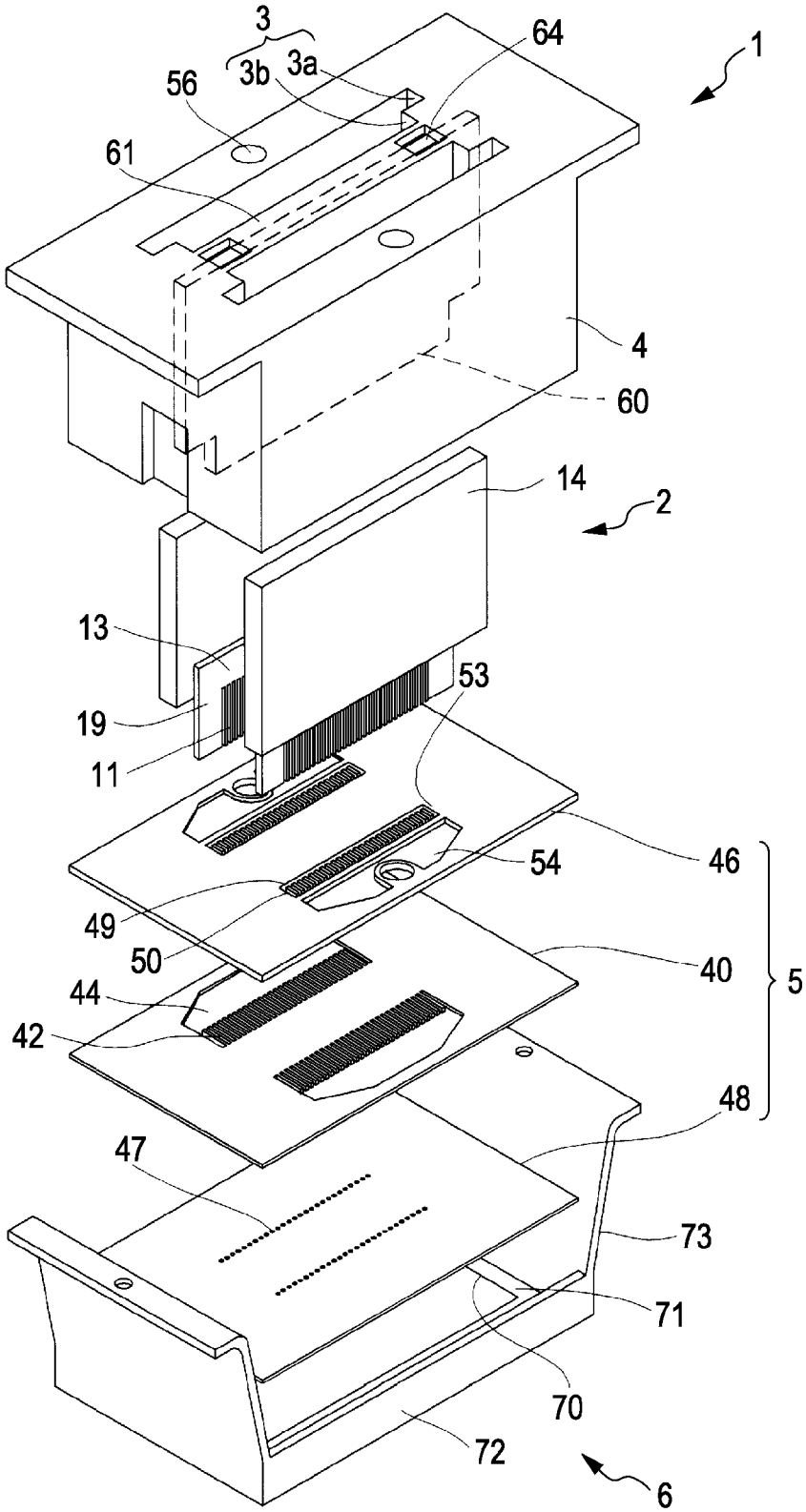
FIG. 1 is an exploded perspective view of a recording head related to Embodiment 1 of the invention.
Figure 2:
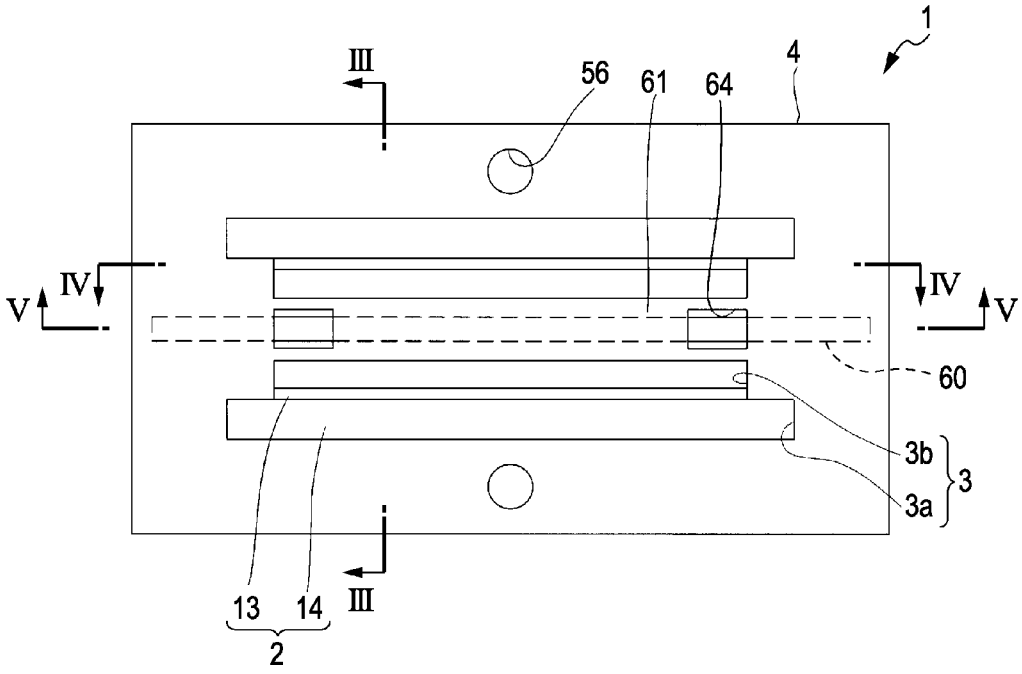
FIG. 2 is a top view of the recording head related to Embodiment 1 of the invention.
Figure 3:
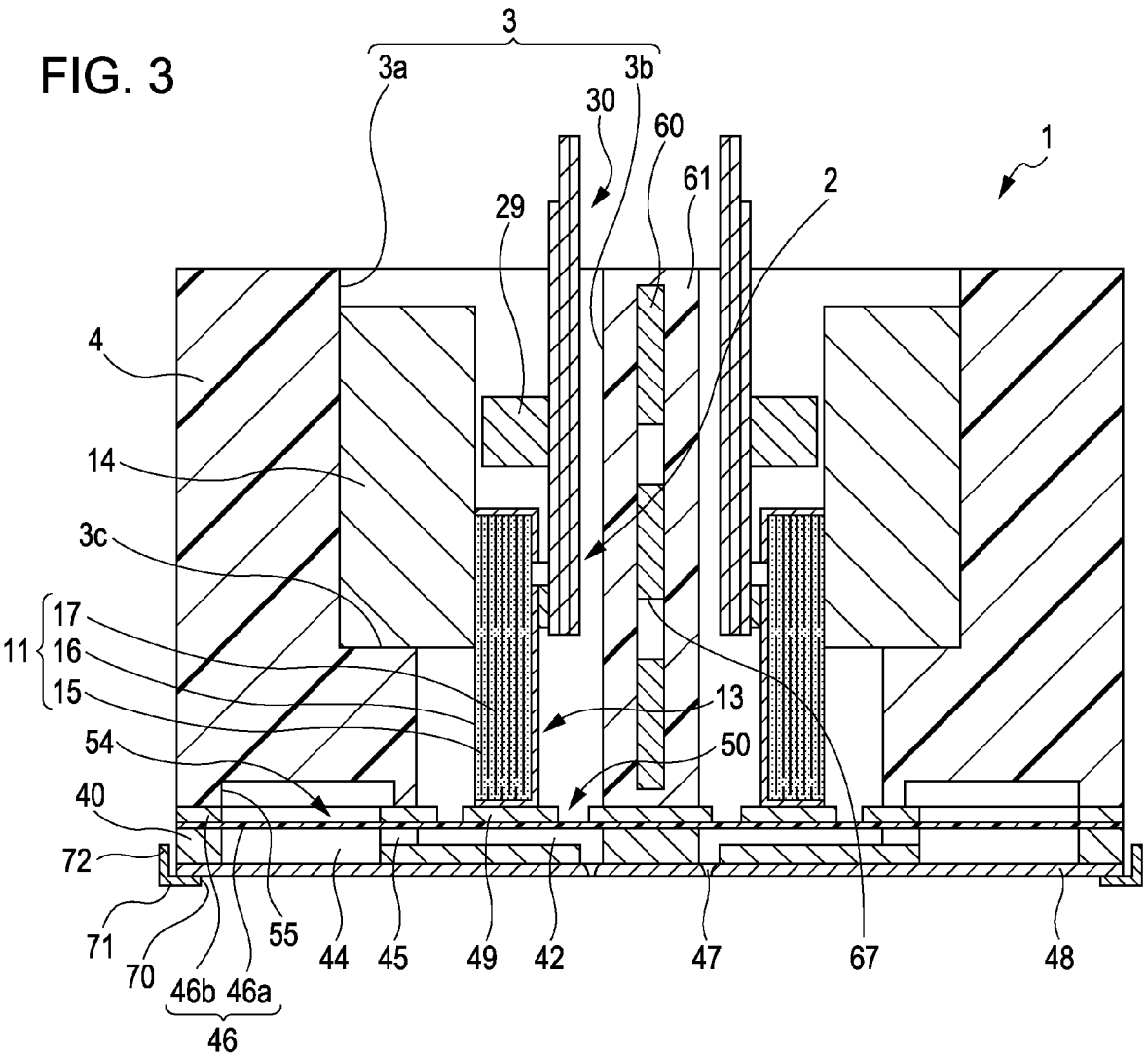
FIG. 3 is a cross-sectional view of the recording head related to Embodiment 1 of the invention.
Figure 4:
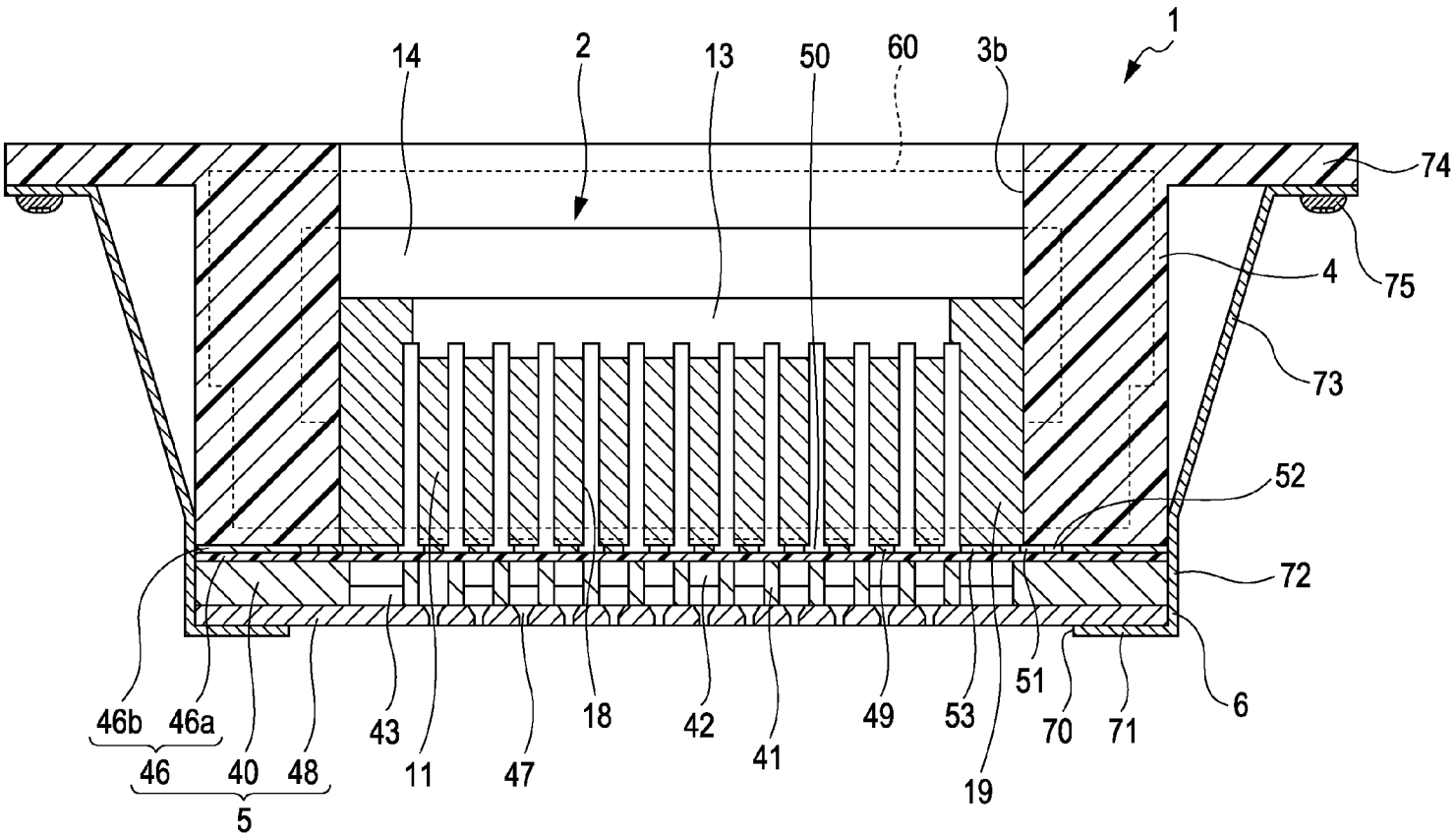
FIG. 4 is a cross-sectional view of the recording head related to Embodiment 1 of the invention.
Figure 5:
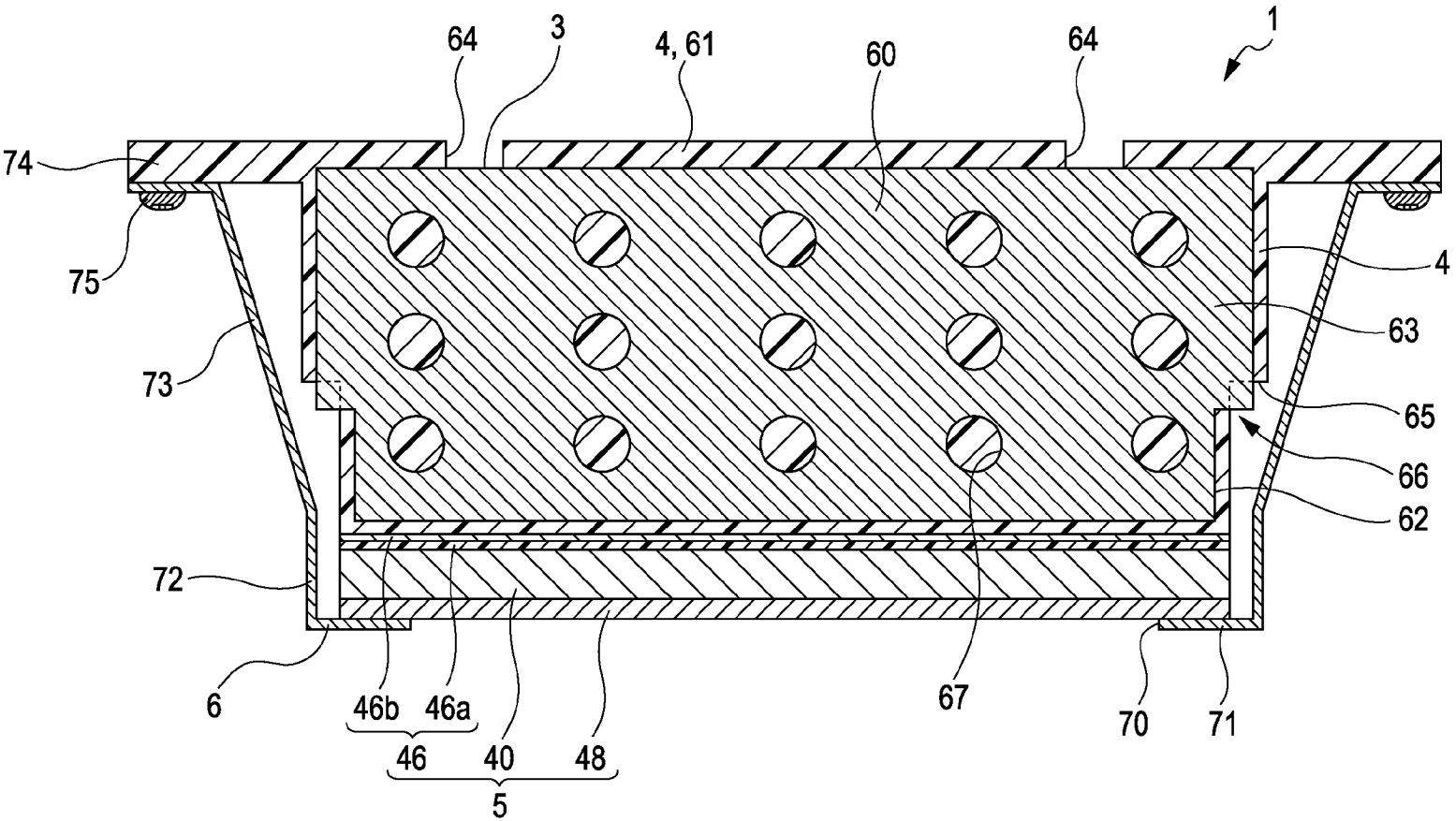
FIG. 5 is a cross-sectional view of the recording head related to Embodiment 1 of the invention.

FIG. 1 is an exploded perspective view of an ink jet type recording head which is one example of a recording head related to Embodiment 1 of the invention, FIG. 2 is a top view of the ink jet type recording head, FIG. 3 is a cross-sectional view taken along line III-III of FIG. 2, FIG. 4 is a cross-sectional view taken along line IV-IV of FIG. 2, and FIG. 5 is a cross-sectional view taken along line V-V of FIG. 2.

As shown in FIG. 1, an ink jet type recording head 1 (hereinafter also referred to as a recording head 1) of this embodiment includes a pair of actuator units 2, a case 4 made of a resin material and provided with housing portions 3 capable of housing the actuator units 2 in the inside, a flow path unit 5 joined to a leading end face of the case 4, and a cover head 6 which covers the flow path unit 5 side.

As shown in FIGS. 3 and 4, the actuator unit 2 of this embodiment includes a piezoelectric element forming member 13 in which a plurality of piezoelectric elements 11 that is an actuator of this embodiment is juxtaposed in the width direction thereof, and a fixed plate 14 in which a base end portion (the other end portion) side of the piezoelectric element forming member 13 is joined thereto as a fixed end such that a leading end portion (one end portion) side of the piezoelectric element forming member 13 becomes a free end.

The piezoelectric element forming member 13 is formed by alternately sandwiching and laminating a piezoelectric material layer 15 and internal electrodes constituting two poles of the piezoelectric element 11, that is, an individual internal electrode 16 constituting an individual electrode electrically independent from an adjacent piezoelectric element 11, and a common internal electrode 17 constituting a common electrode electrically common to an adjacent piezoelectric element 11.

In the piezoelectric element forming member 13, a plurality of slits 18 is formed, for example, by a wire saw or the like and the leading end portion side thereof is carved in a comb-teeth shape, so that a row of piezoelectric elements 11 is formed. In addition, positioning portions 19 having a width wider than that of each piezoelectric element 11 are provided at both outer sides of the row of piezoelectric elements 11. Although the positioning portions 19 are formed by the piezoelectric element forming member 13 similarly to the piezoelectric elements 11, the positioning portions are non-driven vibrators, which are not substantially driven, and are for positioning the actuator unit 2 with high precision by bringing the positioning portions 19 into contact with side surfaces of the housing portion 3 provided at the case 4, when incorporating the actuator unit 2 into the recording head 1.

Here, a region of the piezoelectric element 11, which is joined to the fixed plate 14, is an inactive region which does not contribute to vibration, and if voltage is applied between the individual internal electrode 16 and the common internal electrode 17, which constitute the piezoelectric element 11, only a region on the leading end portion side, which is not joined to the fixed plate 14, vibrates. Then, the leading end face of the piezoelectric element 11 is fixed to an island portion 49 of a vibration plate 46, which will be described later, through an adhesive agent or the like.

Also, a circuit substrate 30 such as a COF, on which a driving circuit 29 such as a driving IC for driving the piezoelectric element 11 is mounted, is connected to each piezoelectric element 11 of the actuator unit 2.

The flow path unit 5 includes a flow path forming substrate 40, the vibration plate 46, and a nozzle plate 48.

The flow path forming substrate 40 is composed of a silicon single crystal substrate, and at a surface layer portion on one face side thereof, pressure generation chambers 42 partitioned by a plurality of partition walls 41 are juxtaposed in the width direction (a short side direction) thereof.

Also, as shown in FIG. 3, a manifold 44 for supplying ink which is one example of a liquid to each pressure generation chamber 42 is communicated with one end portion side in the longitudinal direction of each pressure generation chamber 42 through an ink supply path 45 which is one example of a liquid supply path. Also, an opening face side of the pressure generation chamber 42 of the flow path forming substrate 40 is sealed by the vibration plate 46, and to the other face side, the nozzle plate 48 which is one example of a nozzle forming member in which nozzle orifices 47 are perforated is adhered through an adhesive agent or a thermal welding film. The nozzle orifice 47 of the nozzle plate 48 and the pressure generation chamber 42 communicate with each other through a nozzle orifice communication hole 43 provided penetrating the flow path forming substrate 40.

The vibration plate 46 is formed, for example, by a composite plate of an elastic film 46*a* which is a first member composed of an elastic member such as a resin film and a support plate 46*b* which is a second member supporting the elastic film 46*a* and made of a metal material or the like, for example, and the elastic film 46*a* side is joined to the flow path forming substrate 40. For example, in this embodiment, the elastic film 46*a* which is the first member is composed of a PPS (polyphenylene sulfide) film having a thickness in the order of several μm and the support plate 46*b* which is the second member is composed of a stainless steel plate (SUS) having a thickness in the order of several tens of μm.

Also, in a region facing each pressure generation chamber 42 of the vibration plate 46, the island portion 49 with which the leading end portion of the piezoelectric element 11 comes into contact is provided. That is, at a region facing a peripheral portion of each pressure generation chamber 42 of the vibration plate 46, a thin-walled portion 50 which is thinner in thickness than other regions is formed, and in the inside of the thin-walled portion 50, each island portion 49 is provided. To such an island portion 49, the leading end portion of the piezoelectric element 11 of the above-mentioned actuator unit 2 is fixed through an adhesive agent or the like, for example.

Also, a compliance portion 54 which is substantially constituted only by the elastic film 46*a* by removing the support plate 46*b* by etching, similarly to the thin-walled portion 50, is provided at a region facing the manifold 44 of the vibration plate 46. In addition, the compliance portion 54 plays a role of normally maintaining constant pressure in the manifold 44 by absorbing a pressure change by deformation of the elastic film 46*a* of the compliance portion 54 when a pressure change occurs in the manifold 44.

In addition, in this embodiment, the vibration plate 46 is constituted by the elastic film 46*a* and the support plate 46*b* and a surrounding portion of the island portion 49 and the compliance portion 54 are constituted only by the elastic film 46*a*. However, it is not particularly limited thereto, and the island portion 49 and the compliance portion 54 may be formed, for example, by using a single plate-like member as the vibration plate and providing concave thin-walled portions 50 and 52 and the like, in which a portion in the thickness direction of the plate-like member is removed.

The case 4 is fixed onto the vibration plate 46 of the flow path forming substrate 40, and a liquid storage section (not shown) such as an ink cartridge is connected thereto, whereby the ink supply path 45 which supplies ink to the manifold 44 is provided.

Also, at the case 4, two housing portions 3 penetrating in the thickness direction are provided, and the actuator unit 2 is positioned and fixed to each housing portion 3.

As shown in FIG. 1, the housing portion 3 of such a case 4 has a fixed plate holding portion 3*a* which is provided to have a width wider than that of the fixed plate 14 at a side in which the fixed plate 14 is fixed thereto, and a piezoelectric element holding portion 3*b* which is provided at the piezoelectric element forming member 13 side to have a width narrower than that of the fixed plate holding portion 3*a* and slightly wider than that of the piezoelectric element forming member 13. In addition, the width as mentioned herein is a width in the juxtaposition direction of the piezoelectric elements 11 (the pressure generation chambers 42). Also, as shown in FIG. 3, at the fixed plate holding portion 3*a* of the housing portion 3, a stepped portion 3*c* is provided such that a width on the vibration plate 46 side in a penetration direction becomes narrower, and the fixed plate 14 is fixed with an end surface thereof, in which the piezoelectric elements 11 protrude, come into contact with the stepped portion 3*c*.

Also, at the case 4, a compliance space 55 having a concave shape opening to a region facing the compliance portion 54 is provided. The compliance portion 54 is held to be deformable by the compliance space 55.

Such a case 4 is formed by a resin material. Also, by molding the case 4, the case can be manufactured at low cost and also easily mass-produced.

Further, in the case 4, a reinforcing plate 60 is buried. In this embodiment, the reinforcing plate 60 is buried in a compartment wall 61 which is provided between two housing portions 3 of the case 4, thereby dividing the housing portions 3.

As shown in FIG. 5, the reinforcing plate 60 has a T shape in which a pair of corner portions of a plate-like member having a rectangular shape is cut away. Specifically, the reinforcing plate 60 is provided with concave portions 62 formed by cutting away corner portions on the flow path unit 5 side when it is buried in the case 4, and by the concave portions 62, convex portions 63 laterally protruding are provided at both side faces of the reinforcing plate 60 on the opposite side to the flow path unit 5.

Such a reinforcing plate 60 is buried in the compartment wall 61 of the case 4 in a state where the reinforcing plate is partially exposed to both side faces in the juxtaposition direction of the piezoelectric elements 11 of the case 4 and a face on the opposite side to the flow path unit 5 of the case 4. Specifically, two first exposed portions 64 having a concave shape are provided at the compartment wall 61 of a face on the opposite side to a joint surface of the case 4 to the flow path unit 5, and a side on the opposite side to the flow path unit 5 of the reinforcing plate 60 is partially exposed by first exposed portions 64.

Also, second exposed portions 65 having a concave shape which opens to a side face and a face on the flow path unit 5 side are respectively provided at both side faces in the juxtaposition direction of the piezoelectric elements 11 of the case 4. The second exposed portions 65 are provided at the side faces of the case 4 to have a depth deeper than a depth up to the convex portion 63 of the reinforcing plate 60 and shallower than the concave portion 62. Corner portions 66 on the concave portion 62 side of the convex portions 63 of the reinforcing plate 60 are exposed by the second exposed portions 65. That is, in the reinforcing plate 60, the face on the opposite side to the flow path unit 5 is exposed by the first exposed portions 64 and the face on the flow path unit 5 side and both side faces (both sides in the juxtaposition direction of the piezoelectric elements 11) are exposed by the second exposed portions 65.

As for such a reinforcing plate 60, a material having strength higher than that of the case 4, for example, a metal material such as stainless steel, a resin material having strength higher than that of the case, glass ceramics, or the like can be used.

Also, the reinforcing plate 60 is integrated by a so-called insert molding in which filling is performed by placing it in a mold, which molds the case 4 by using a resin material, in advance and injection-molding a resin material into the mold. Then, the above-described first and second exposed portions 64 and 65 are formed by support of holding jigs which perform positioning in the mold when molding the case 4.

In addition, at the reinforcing plate 60, a plurality of flow holes 67 which penetrates in the thickness direction is provided. By the flow holes 67, it is possible to improve fluidity of a resin material, which is filled in the mold, thereby reliably filling the mold with the resin material.

Here, a manufacturing method of the case will be described in more detail with reference to FIGS. 6A and 6B. In addition, FIGS. 6A and 6B are cross-sectional views showing the manufacturing method of the case.

Figure 6A:
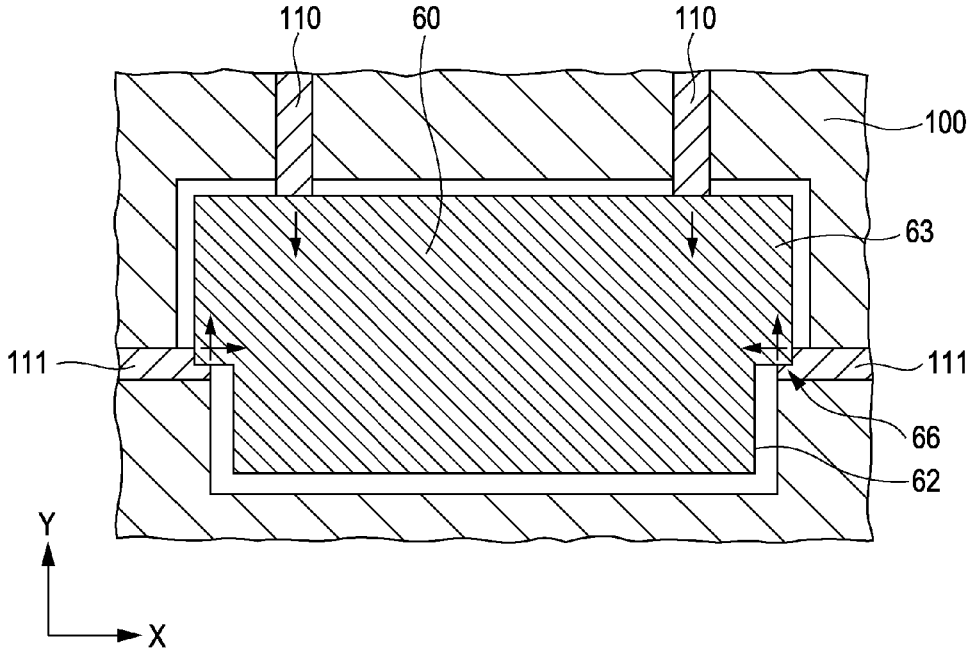
FIGS. 6A and 6B are cross-sectional views showing a manufacturing method of a case related to Embodiment 1 of the invention.

As shown in FIG. 6A, the reinforcing plate 60 is positioned and held in a mold 100. Holding of the reinforcing plate 60 in the mold 100 is performed by pressing four places of an outer circumference of the reinforcing plate 60 by holding jigs 110 and 111. The holding jigs 110 come into contact with the face on the opposite side to the flow path unit 5 of the reinforcing plate 60. Also, the holding jigs 111 come into contact with the corner portions 66 on the concave portion 62 side of the convex portions 63 of the reinforcing plate 60. In addition, the holding jigs 111 coming into contact with the corner portions 66 indicates that the holding jigs 111 come into contact with the face on the flow path unit 5 side of the reinforcing plate 60 and both side faces in the juxtaposition direction of the piezoelectric elements 11 of the reinforcing plate 60. In this manner, the holding jigs 111 press side faces on both sides in the juxtaposition direction of the piezoelectric elements 11 among the corner portions 66 of the convex portions 63 provided at both side faces in the juxtaposition direction of the piezoelectric elements 11, with respect to one another, thereby positioning the reinforcing plate 60 in the mold 100 in a state where movement of the reinforcing plate in an X direction is restricted. By clamping both side faces in the juxtaposition direction of the piezoelectric elements 11 of the reinforcing plate 60 by two holding jigs 111, positioning in the X direction of the reinforcing plate 60 in the mold 100 is performed. Also, by pressing the faces on the flow path unit 5 side of the corner portions 66 of the convex portions 63 with respect to one another by the holding jigs 111 and pressing the face on the opposite side to the flow path unit 5 of the reinforcing plate 60 by the holding jigs 110, positioning of the reinforcing plate 60 in the mold 100 is performed in a state where movement in a Y direction of the reinforcing plate is restricted. As a result, the reinforcing plate 60 is positioned and held in a state where movement of the reinforcing plate in the X direction and the Y direction with respect to the mold is restricted.

Figure 6B:
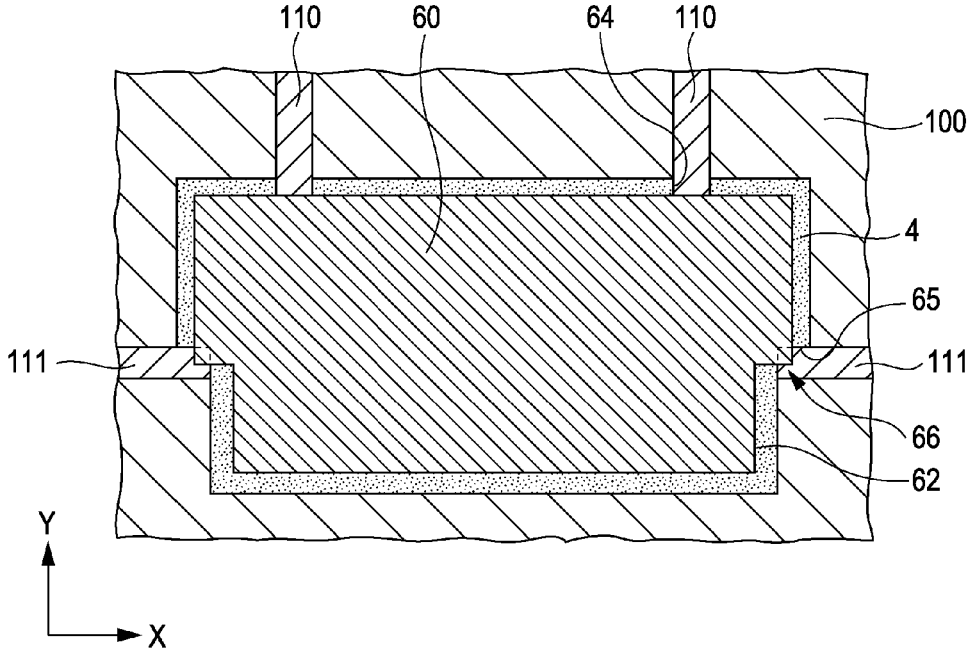

In such a state, as shown in FIG. 6B, by filling a melted resin material between the mold 100 and the reinforcing plate 60, it is possible to form a case in which the reinforcing plate 60 is buried in the inside portion. At this time, two first exposed portions 64 and two second exposed portions 65, which expose the reinforcing plate 60, are formed by the holding jigs 110 and 111 positioning and holding the reinforcing plate 60.

Further, as shown in FIGS. 1, and 3 to 5, at the recording head 1, the cover head 6 covering a discharge face side is provided at a face side, in which the nozzle orifices 47 open, in a state where the nozzle orifices 47 are exposed.

The cover head 6 includes an opening portion 70 exposing the nozzle orifices 47 and a frame portion 71 defining the opening portion 70.

In this embodiment, the frame portion 71 is provided over the periphery of a discharge face, and a side wall portion 72 extended and provided so as to be bent over an outer circumferential edge portion of the discharge face is provided at the frame portion 71.

Also, fixed portions 73 extended and provided at both sides in the juxtaposition direction of the nozzle orifices 47 are provided at the side wall portion 72. The fixed portions 73 are provided being bent from the side wall portion 72 and are fixed to a flange portion 74, which protrudes from a side face of the case 4, through a fixing screw 75. As a result, the cover head 6 is integrated with the recording head 1.

The fixed portion 73 bent from such a side wall is provided in such a manner that a gap between it and the case 4 gradually increases toward the opposite side to the flow path unit 5. Specifically, the side wall portion 72 is provided perpendicular to the flow path unit 5, and a starting point of the fixed portion 73 with respect to the side wall portion 72 is located further on the flow path unit 5 side than the corner portion 66 of the reinforcing plate 60 exposed by the second exposed portion 65 of the case 4. Then, the gap between the fixed portion 73 and the case 4 is provided so as to gradually increase from the starting point toward the flange portion 74 of the case 4.

In this manner, by gradually increasing the gap between the fixed portion 73 and the case 4 toward the opposite side to the flow path unit 5 (the discharge face), even if ink penetrates between the cover head 6 and the flow path unit 5 or the case 4, creeping of the penetrated ink to the opposite side to the flow path unit 5 of the case 4 due to capillarity can be suppressed.

In addition, as the cover head 6, for example, a metal material such as stainless steel can be used. Also, the cover head 6 may be formed by press-working a metal plate or may be formed by molding.

In such a recording head 1, when discharging an ink droplet, the ink droplet is discharged from a given nozzle orifice 47 by changing the volume of each pressure generation chamber 42 by deformation of the piezoelectric element 11 and the vibration plate 46. Specifically, if ink is supplied from an ink cartridge (not shown) to the manifolds 44 through ink introduction holes 56 provided at the case 4, the ink is distributed to each pressure generation chamber 42 through the ink supply path 45. In fact, the piezoelectric element 11 contracts by applying voltage to the piezoelectric element 11. Accordingly, the vibration plate 46 is deformed together with the piezoelectric element 11, so that the volume of the pressure generation chamber 42 is expanded, whereby the ink is drawn into the pressure generation chamber 42. Then, after the inner side up to the nozzle orifice 47 is filled with ink, the voltage applied to the electrodes 16 and 17 of the piezoelectric element 11 is released in accordance with a recording signal which is supplied through the circuit substrate 30. Accordingly, the piezoelectric element 11 is extended, thereby returning to the original state, and the vibration plate 46 is also displaced, thereby returning to the original state. As a result, the volume of the pressure generation chamber 42 contracts, so that pressure in the pressure generation chamber 42 is increased, whereby an ink droplet is discharged from the nozzle orifice 47.

Then, in this embodiment, by providing the reinforcing plate 60 in the case 4, even if the case 4 expands in accordance with a temperature change or a humidity change of a resin portion of the case 4, deformation of the entire case 4 is suppressed, so that pull-up of the actuator unit 2 fixed to the case 4 to the opposite side to the vibration 46 can be reduced. Also, at the time of driving of the juxtaposed piezoelectric elements 11, since floating due to a difference in rigidity of the case 4 at the piezoelectric elements 11 on both end portion sides in the juxtaposition direction and the piezoelectric element 11 on the central portion side can be suppressed, an improvement and homogenization of ink discharge characteristics can be attained.

Figure 7:
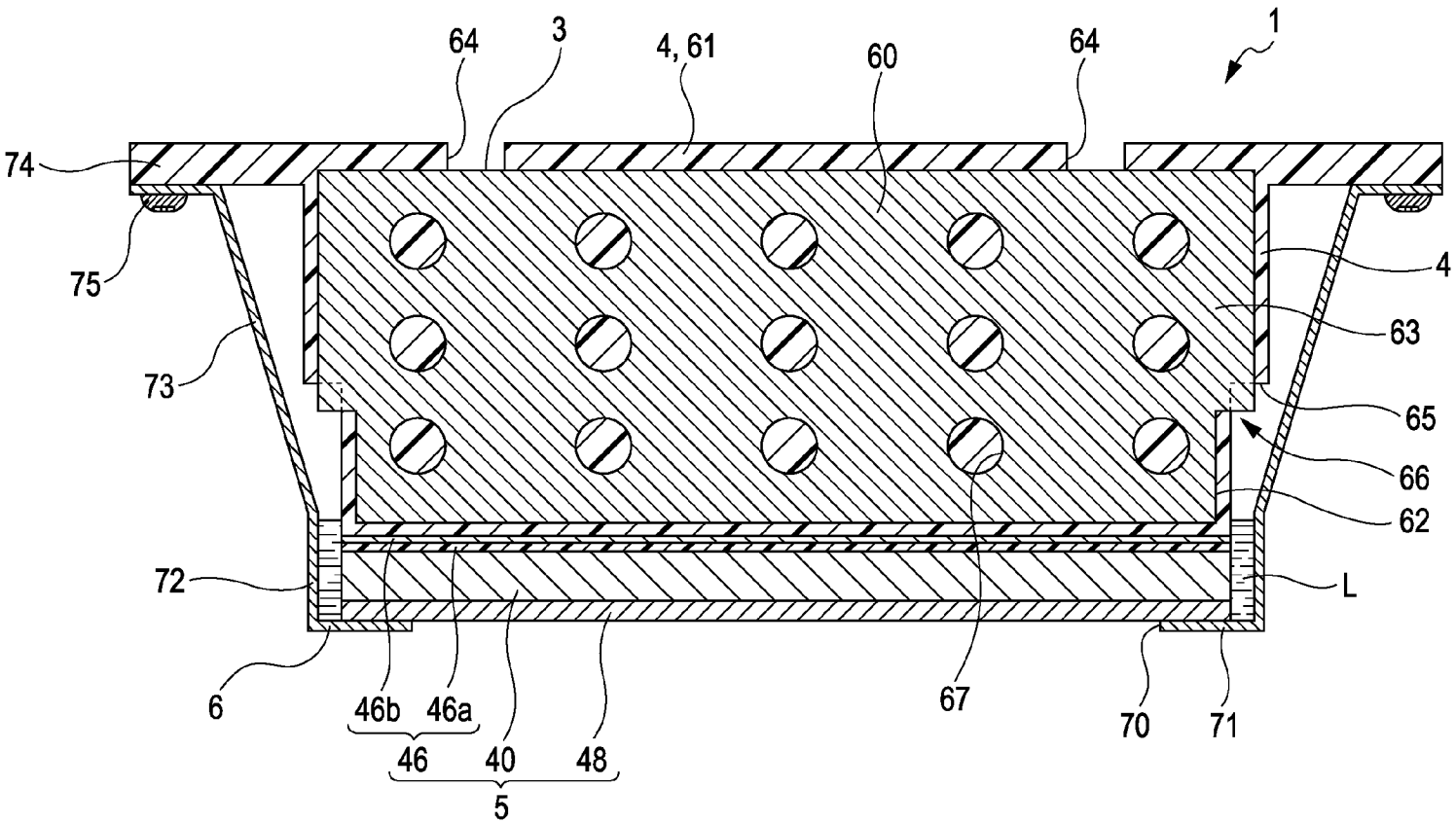
FIG. 7 is a cross-sectional view showing the recording head related to Embodiment 1 of the invention.
Figure 8:
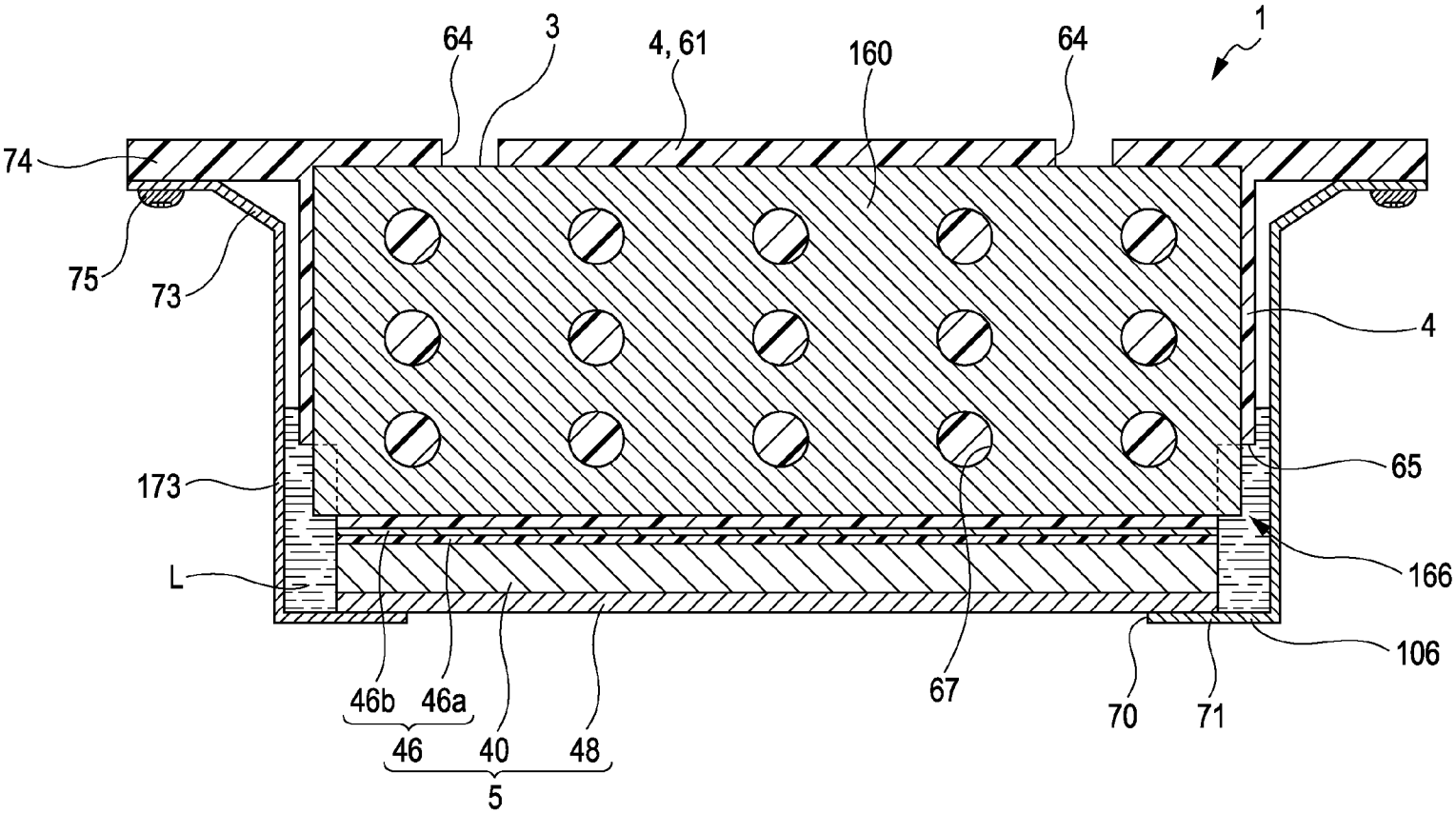
FIG. 8 is a cross-sectional view showing a comparative example of the recording head related to Embodiment 1 of the invention.

Also, in this embodiment, the concave portions 62 are provided at the discharge face side of the reinforcing plate 60, and the corner portions 66 on the flow path unit 5 side of the convex portions 63 formed by the concave portions 62 are made so as to be exposed by the second exposed portions 65. For this reason, as shown in FIG. 7, since the regions (the corner portions 66) exposed by the second exposed portions 65 of the reinforcing plate 60 are separated from the discharge face, ink L penetrated between the cover head 6, the flow path unit 5, and the case 4 does not reach the reinforcing plate 60 exposed by the second exposed portions 65 and creeping of ink at an interface between the reinforcing plate 60 and the resin material from the second exposed portions 65 can be suppressed. Incidentally, as shown in FIG. 8, in the case of a reinforcing plate 160 in which concave portions are not provided, if corner portions 166 on the discharge face side are exposed by the second exposed portions 65, the discharge face and the corner portions 166 of the reinforcing plate 160 exposed by the second exposed portions 65 become close to each other. Then, if the discharge face and the reinforcing plate 160 exposed by the second exposed portions 65 are close to each other, the ink L penetrated between the cover head 6, the flow path unit 5, and the case 4 reaches the reinforcing plate 160 exposed by the second exposed portions 65, and the ink then creeps an interface between the reinforcing plate 160 and the resin material due to capillarity, so that the ink penetrates into the housing portions 3 from the first exposed portions 64 side on the opposite side to the discharge face, thereby damaging the piezoelectric elements 11.

Further, in this embodiment, as shown in FIG. 7, since the fixed portions 73 of the cover head 6 are made such that the gap between it and the case 4 gradually increases toward the opposite side to the discharge face, it is difficult for ink to penetrate into a clearance between the cover head 6 and the case 4, and since creeping of the penetrated ink L to the opposite side to the discharge face can be suppressed, arrival of ink at the reinforcing plate 60 exposed by the second exposed portions 65 can be suppressed. Also due to this, penetration of ink into the housing portions 3 is suppressed, so that damage of the piezoelectric elements 11 by ink can be suppressed. On the contrary, as shown in FIG. 8, if fixed portions 173 of a cover head 106 are vertically provided, since the ink L penetrated between the case 4 and the cover head 106 creeps due to capillarity, also due to this, the ink reaches the reinforcing plate 160 exposed by the second exposed portions 65.

Other Embodiments

One embodiment of the invention has been described above. However, a basic configuration of the invention is not limited to the aforesaid.

Figure 9:
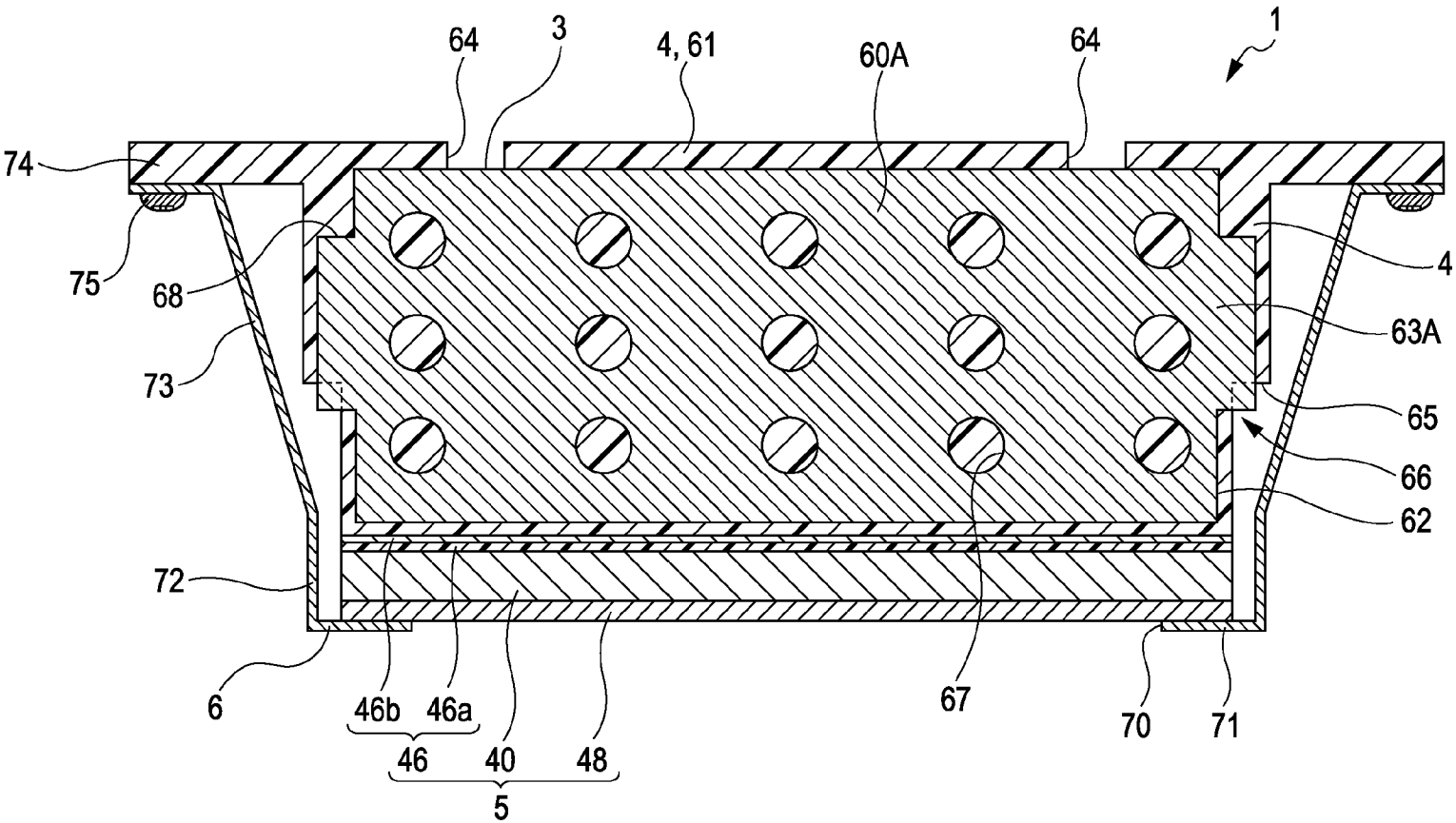
FIG. 9 is a cross-sectional view showing a modified example of a reinforcing plate related to another embodiment of the invention.

For example, in Embodiment 1 described above, the convex portions 63 are formed by providing the concave portions 62 at the flow path unit 5 side of the reinforcing plate 60. However, cutout portions each having the same concave shape as the concave portion 62 may be further provided at the opposite side to the flow path unit 5 side of the reinforcing plate. Such an example is shown in FIG. 9. In addition, FIG. 9 is a cross-sectional view of a recording head showing a modified example of the reinforcing plate.

As shown in FIG. 9, at a reinforcing plate 60A, the concave portions 62 on the flow path unit 5 side and cutout portions 68 on the opposite side to on the flow path unit 5 are provided, and a convex portion 63A is provided between each concave portion 62 and each cutout portion 68. Even at such a reinforcing plate 60A, the same effects as those of Embodiment 1 described above can be displayed.

Also, for example, in Embodiment 1 described above, the reinforcing plate 60 is buried in the compartment wall 61 of the case 4. However, a buried position of the reinforcing plate 60 is not particularly limited and, for example, the reinforcing plate 60 may be buried in the peripheral wall side of the case 4, to which the fixed plate 14 is fixed.

Also, in Embodiment 1 described above, as a pressure generation section which generates a pressure change in the flow path (the pressure generation chamber 42), a longitudinal vibration type piezoelectric element 11 which is constituted by alternately laminating the piezoelectric material layer 15, the individual internal electrode 16, and the common internal electrode 17 and extends and contracts in an axial direction is illustrated. However, the pressure generation section is not particularly limited thereto and a lateral vibration type piezoelectric element may be used which is constituted by alternately laminating the piezoelectric material layer 15, the individual internal electrode 16, and the common internal electrode 17 and in which one end portion in a lamination direction comes into contact with an island portion.

Also, as the pressure generation section, for example, a thin-film type piezoelectric element may be used in which a lower electrode, a piezoelectric body layer composed of a piezoelectric material, and an upper electrode are formed by film formation and a lithography method, and a thick-film type piezoelectric element can also be used which is formed by a method such as adhesion of a green sheet. Also, as the pressure generation section, a pressure generation section in which a heat generation element is disposed in a pressure generation chamber and a liquid droplet is discharged from a nozzle orifice by a bubble which is generated by heat generation of the heat generation element, a pressure generation section in which static electricity is generated between a vibration plate and an electrode and a liquid droplet is discharged from a nozzle orifice by deforming the vibration plate by an electrostatic force, or the like can also be used.

Figure 10:
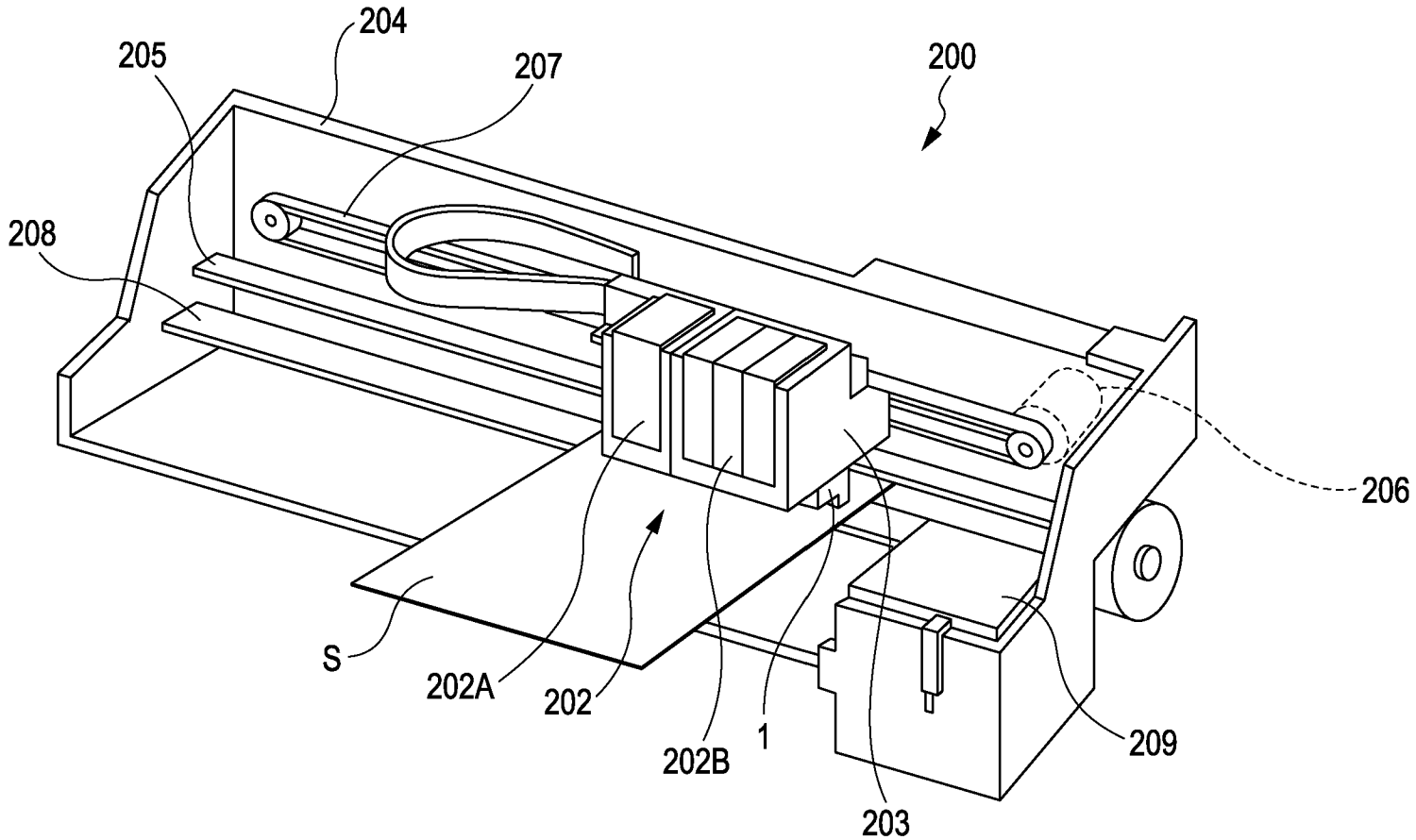
FIG. 10 is a view showing a schematic configuration of a recording apparatus related to one embodiment of the invention.

Also, the ink jet type recording head 1 of each of the embodiments constitutes a portion of an ink jet type recording head unit, which is provided with an ink flow path communicating with an ink cartridge and the like, thereby being mounted on an ink jet type recording apparatus. FIG. 10 is a schematic view showing one example of the ink jet type recording apparatus.

In an ink jet type recording apparatus 200 shown in FIG. 10, cartridges 202A and 202B constituting an ink supply section are detachably mounted on an ink jet type recording head unit 202 (hereinafter simply also referred to as a head unit 202) having a plurality of ink jet type recording heads 1, and a carriage 203 with the head unit 202 mounted thereon is mounted on a carriage shaft 205 attached to an apparatus main body 204 so as to be movable in an axial direction. The head unit 202 is set to discharge a black ink composition and a color ink composition, for example.

Then, a driving force of a driving motor 206 is transmitted to the carriage 203 through a plurality of gears (not shown) and a timing belt 207, whereby the carriage 203 with the head unit 202 mounted thereon is moved along the carriage shaft 205. On the other hand, at the apparatus main body 204, a platen 208 is provided along the carriage shaft 205, and a recording sheet S which is a recording medium such as paper fed by a paper feed roller (not shown) and the like is wound around the platen 208 and transported.

Also, in the ink jet type recording apparatus 200 described above, a configuration is illustrated in which the head unit 202 having a plurality of recording heads 1 is mounted on the carriage 203 and moved in a main scanning direction. However, it is not particularly limited thereto and the invention can also be applied to, for example, a so-called line type recording apparatus in which the recording head 1 is fixed and printing is performed only by moving the recoding sheet S such as paper in a sub-scanning direction.

Also, in the example described above, a configuration is made such that the head unit 202 having a plurality of recording heads 1 is mounted on the ink jet type recording apparatus 200. However, one recording head 1 may be mounted on the head unit 202 and single or a plurality of recording heads 1 may be directly mounted on the ink jet type recording apparatus 200.

In addition, in the embodiments described above, the ink jet type recording head is taken and described as one example of the liquid ejecting head. However, the invention broadly targets liquid ejecting heads in general and, of course, can also be applied to a liquid ejecting head which ejects liquid other than ink. As other liquid ejecting heads, for example, various recording heads which are used in an image recording apparatus such as a printer, a color material ejecting head which is used for the manufacturing of a color filter of a liquid crystal display or the like, an electrode material ejecting head which is used for the electrode formation of an organic EL display, an FED (field emission display), or the like, a biological organic matter ejecting head used for the manufacturing of a biochip, and the like can be given as examples.

What is claimed is:

1. A liquid ejecting head comprising:

a flow path unit in which nozzle orifices and flow paths communicating with the nozzle orifices are provided;

a case fixed to the flow path unit; and an actuator unit which is fixed to the case and in which actuators that generate a pressure change in the flow paths are juxtaposed, wherein the case is formed by a resin molding material and also a reinforcing plate is buried in the case over a juxtaposition direction of the actuators, first exposed portions in which the reinforcing plate is exposed are provided at a face on the opposite side to a face of the case, which is fixed to the flow path unit, concave portions are provided at both side faces of the reinforcing plate in the juxtaposition direction of the actuators on a discharge face side in which the nozzle orifices are opened, and second exposed portions, in which corner portions that include the discharge face sides of convex portions formed by the concave portions and the side faces of the reinforcing plate are exposed, are provided at both side faces of the case in the juxtaposition direction of the actuators.

2. The liquid ejecting head according to claim 1, wherein cutout portions which are opened to a face on the opposite side to the discharge face are provided at both side faces of the reinforcing plate in the juxtaposition direction of the actuators on the opposite side to the concave portions, and the convex portion is provided between the concave portion and the cutout portion.

3. The liquid ejecting head according to claim 1, wherein at a discharge face side of the flow path unit, a cover head covering the discharge face is provided, and the corner portions are covered by the cover head.

4. The liquid ejecting head according to claim 3, wherein the cover head is provided such that a clearance between the cover head and the case gradually increases from the discharge face toward the case side.

5. A liquid ejecting head unit comprising: a plurality of the liquid ejecting heads according to claim 1.

6. A liquid ejecting apparatus comprising: the liquid ejecting head unit according to claim 5.

7. A liquid ejecting apparatus comprising: the liquid ejecting head according to claim 1.

* * * * *